US007654341B2

(12) United States Patent
Tjader

(10) Patent No.: US 7,654,341 B2
(45) Date of Patent: Feb. 2, 2010

(54) DRILL STEM COUPLING AND METHOD FOR A DIRECTIONAL DRILL

(75) Inventor: Michael Tjader, New Richmond, WI (US)

(73) Assignee: TT Technologies, Inc., Aurora, IL (US)

( * ) Notice: Subject to any disclaimer, the term of this patent is extended or adjusted under 35 U.S.C. 154(b) by 449 days.

(21) Appl. No.: 11/553,337

(22) Filed: Oct. 26, 2006

(65) Prior Publication Data

US 2008/0099242 A1 May 1, 2008

(51) Int. Cl.
*E21B 17/042* (2006.01)

(52) U.S. Cl. ..... 175/57; 175/325.2; 175/325.5

(58) Field of Classification Search ..... 175/40, 175/57, 325.2, 325.5–325.7
See application file for complete search history.

(56) References Cited

U.S. PATENT DOCUMENTS 4,916,400 A * 4/1990 Best et al. ..... 324/338
5,417,291 A * 5/1995 Leising ..... 175/320
5,581,024 A * 12/1996 Meyer, Jr. et al. ..... 73/152.03
5,934,391 A * 8/1999 Cox ..... 175/73
6,216,090 B1 * 4/2001 Hagiwara ..... 702/7
6,439,319 B1 * 8/2002 Wentworth et al. ..... 175/61
6,543,556 B1 * 4/2003 Anderson ..... 175/293
6,710,600 B1 * 3/2004 Kopecki et al. ..... 324/338
6,860,514 B2 3/2005 Wentworth et al.
7,219,736 B1 * 5/2007 Levy ..... 166/336
7,413,033 B2 * 8/2008 Tjader ..... 175/75
2006/0131077 A1 * 6/2006 Tjader ..... 175/73

* cited by examiner

*Primary Examiner*—Shane Bomar
(74) *Attorney, Agent, or Firm*—Schwegman Lundberg & Woessner, P.A.

(57) ABSTRACT

A drill stem connection assembly includes a first drill stem section and a second drill stem section. At least one engaging feature is located at an end of the first drill stem section. At least one mating feature accepts the at least one engaging feature. The at least one mating feature is located at an end of the second drill stem section. Coupling of the respective ends of the first and second drill stem sections forms a drill stem joint. A threaded collar engages with at least one of the coupled first and second drill stem sections. When placed in a securing position, the threaded collar holds the engaging feature securely mated with the mating feature and at least partially covers the drill stem joint.

32 Claims, 7 Drawing Sheets

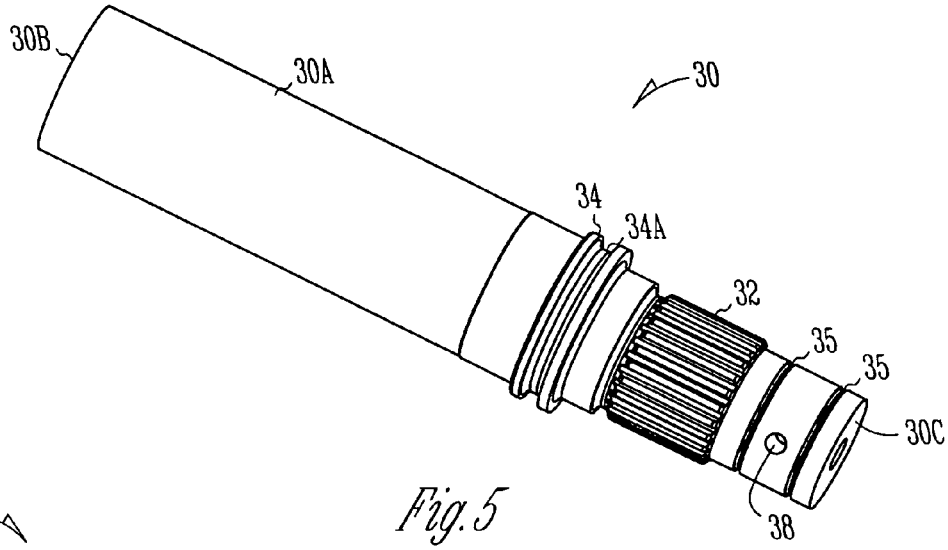
Fig. 5
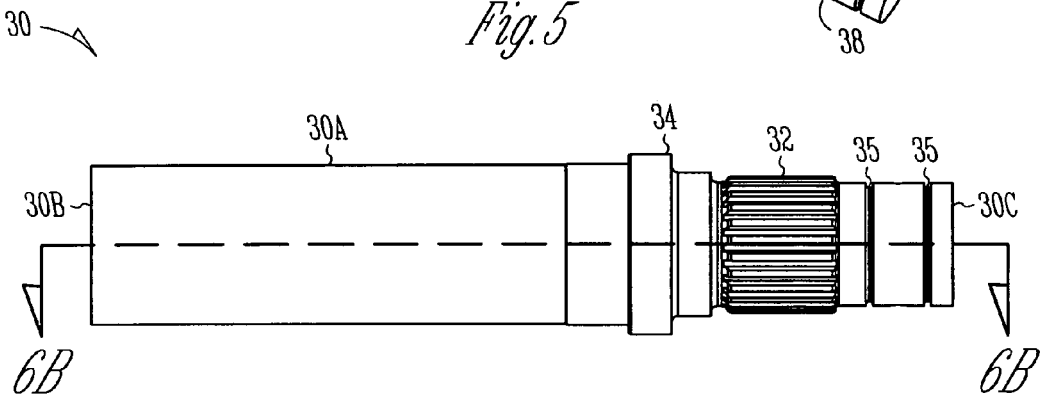
Fig. 6A
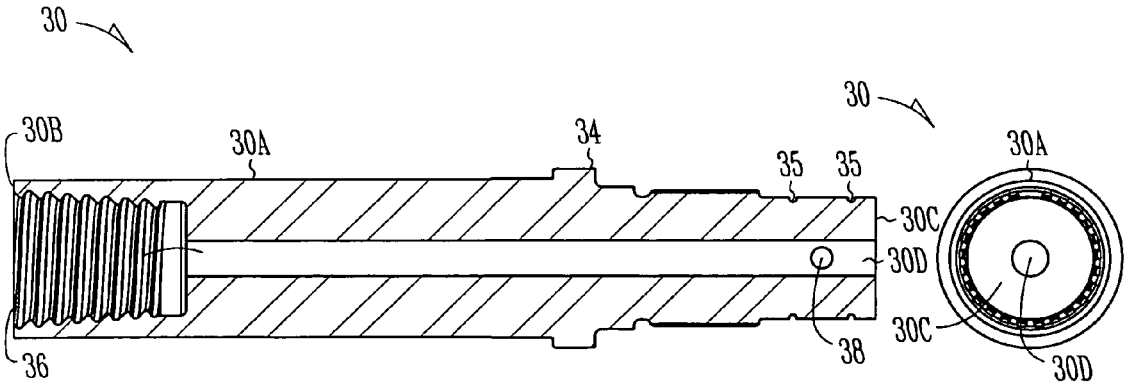
Fig. 6B
Fig. 6C

DRILL STEM COUPLING AND METHOD FOR A DIRECTIONAL DRILL

TECHNICAL FIELD

This invention relates to ground drilling equipment. Specifically, this invention relates to connection designs for components of drill stems.

BACKGROUND

Directional drilling is a useful technique for several procedures such as utility installation, etc. One common type of directional drilling is horizontal directional drilling, where a drill stem is extended essentially horizontally to form passages under structures such as roads for example.

The drill stem typically includes multiple components, including a drill head, a sonde housing, sections of drill rod, etc. Drill heads in directional drilling typically have a feature which causes the drill head to steer in one direction when forced ahead by a drilling device. During a boring operation, pressure is applied through the drill stem from behind to the drill head. During a straight bore, the drill stem is typically rotated at a regular rate so that on average, only straight ahead drilling is accomplished. In order to steer a drill head, the rotation is temporarily stopped, and the drill head is allowed to steer in the desired direction. Once the steering maneuver is complete, the drill head is again rotated at a regular rate for straight ahead drilling.

Ground drilling requires large amounts of forward linear force, as well as large amounts of torque, applied to the drill stem. The drill stem also experiences frictional forces due to the interaction of the drill stem with the medium (i.e., soil, rock, sand, clay, etc.) through which the drill stem is traveling during a boring operation. Therefore, for a successful boring operation, it is necessary that the components, as well as the couplings therebetween, be able to withstand the various drilling forces without failure.

Various coupling designs and methods have been employed to connect drill stem components. One common method of connecting drill stem components is to threadingly couple one component to another, such that the linear and the rotational forces experienced during a drilling operation are transmitted from one component to the other through the threads of the adjoining components. Because of this, such threaded couplings are difficult to remove after the drilling operation is complete due to tightening of the threads during rotation of the drill stem in a drilling operation. Large tools, such as a pipe wrench, are frequently needed to disconnect the threaded-together drill stem components. Pipe wrenches or similar methods requiring large forces are inconvenient, and may be dangerous to the operator.

What is needed is a drill stem component connection system and method that provides structural integrity for drilling operations, while providing ease of assembly and disassembly with an increased level of safety.

BRIEF DESCRIPTION OF THE DRAWINGS

FIG. 5 shows an adapter of a drilling device according to an embodiment of the invention.

FIGS. 6A-6C show views of an adapter of a drilling device according to an embodiment of the invention.

DETAILED DESCRIPTION

Figure 1:
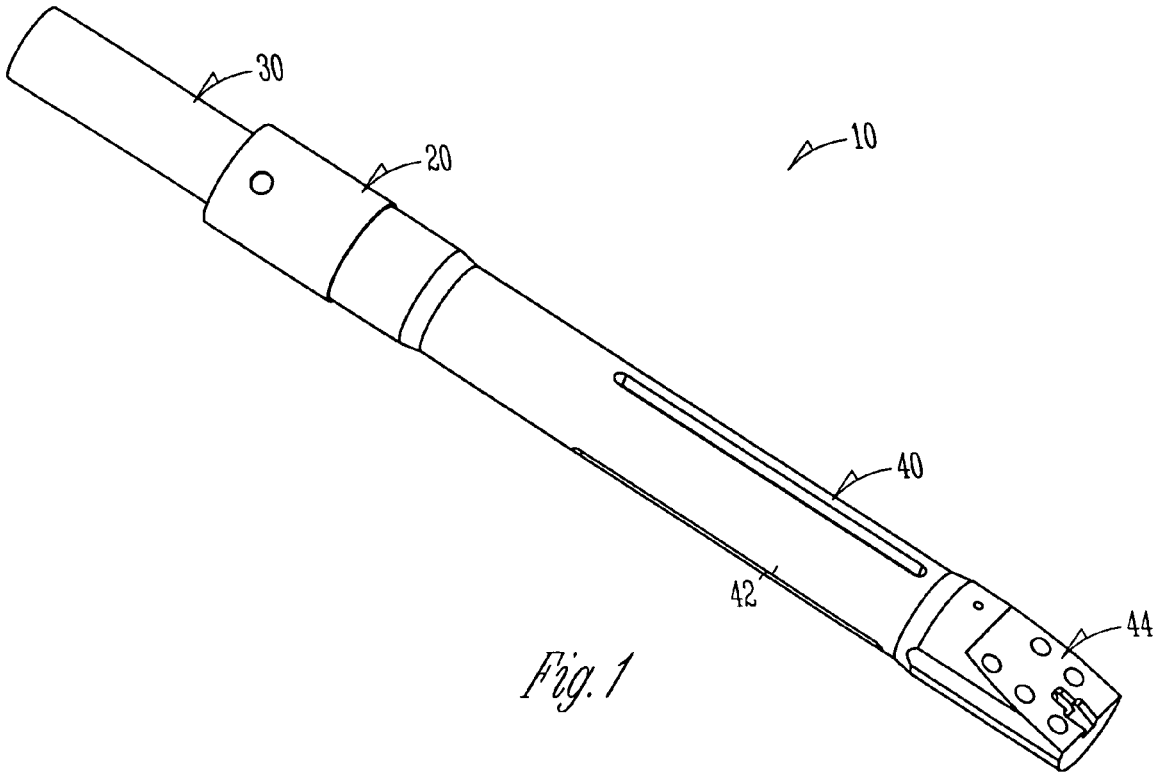
FIG. 1 shows a drilling device according to an embodiment of the invention.

In the following detailed description, reference is made to the accompanying drawings which form a part hereof, and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, or logical changes, etc. may be made without departing from the scope of the present invention. In the following descriptions, a drill stem is defined to include any component that is advanced from a drilling device. A drill rod is defined as a section of pipe, solid material, etc. where sections of drill rod are coupled together to form a main part of a drill stem. Various drill stem components such as a drill head, a drilling blade holder, a sonde housing, etc. can be attached to the front end of a number of drill rods during one embodiment of a typical drilling operation.

Figure 2:
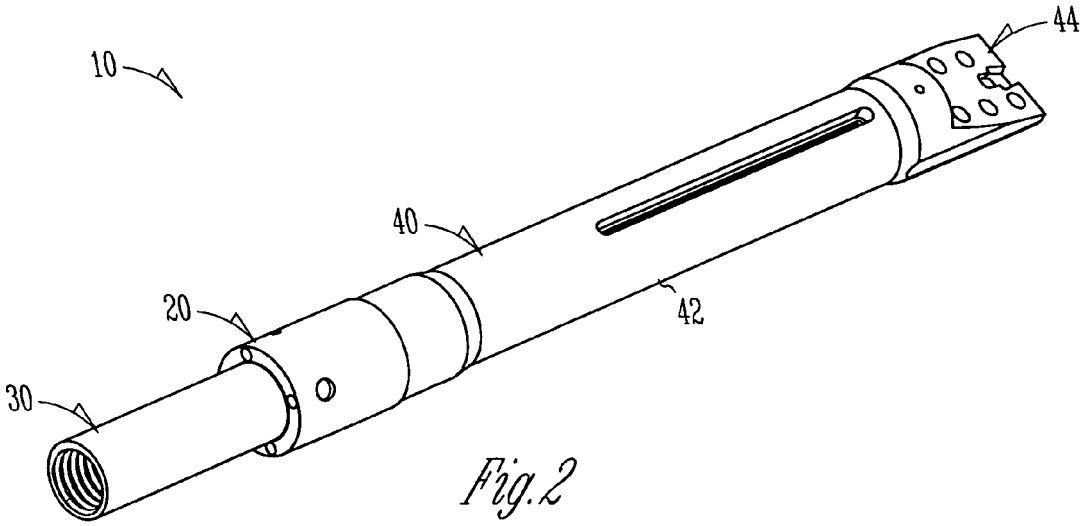
FIG. 2 shows a drilling device according to an embodiment of the invention.
Figure 3:
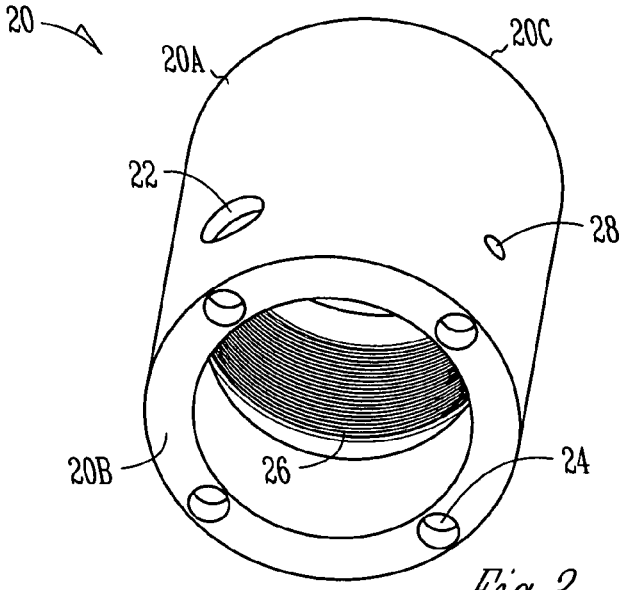
FIG. 3 shows a threaded collar of a drilling device according to an embodiment of the invention.
Figure 4A:
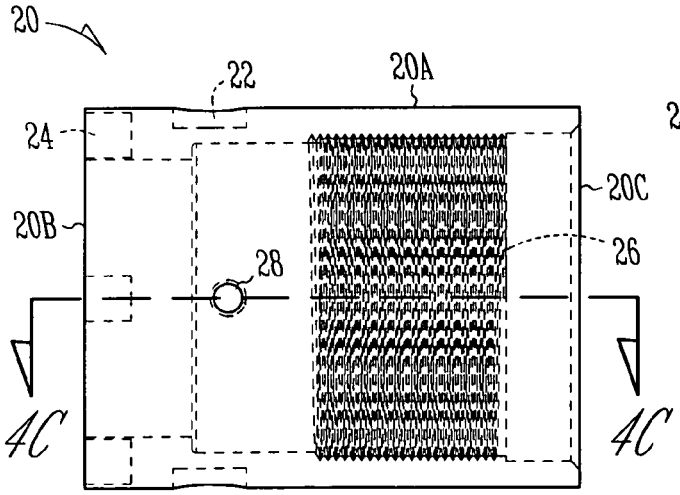
FIGS. 4A-4C show views of a threaded collar of a drilling device according to an embodiment of the invention.
Figure 4B:
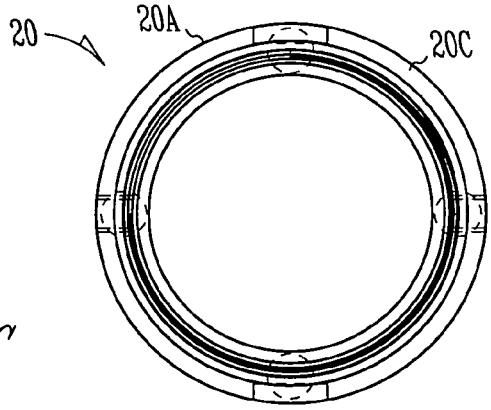
Figure 4C:
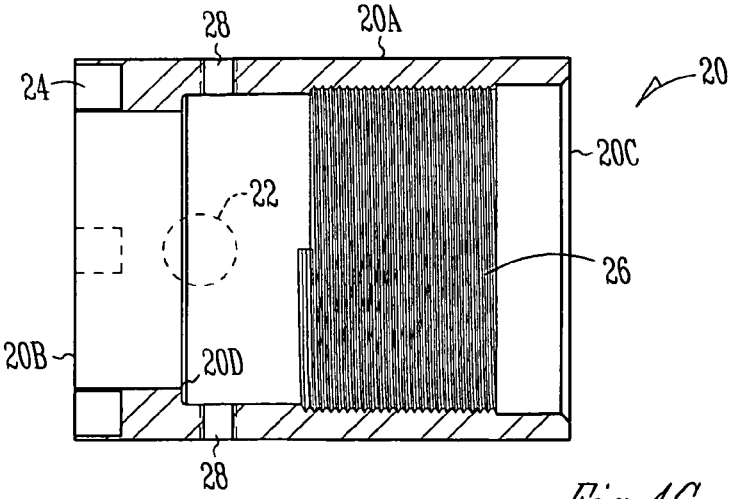
Figure 7:
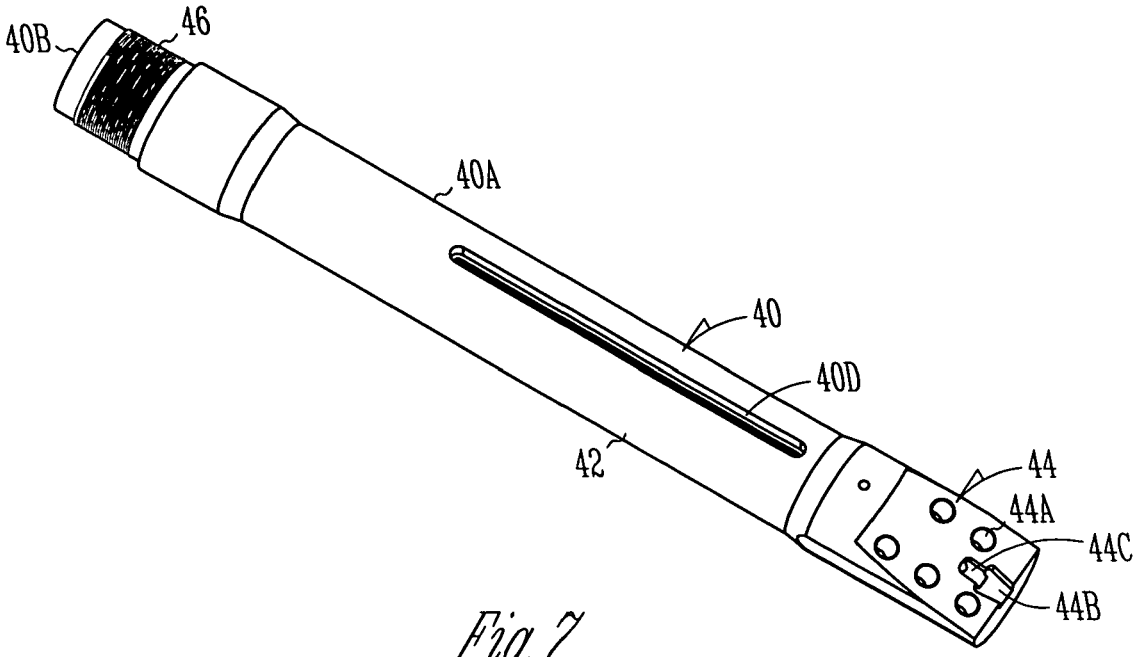
FIG. 7 shows a drill stem section of a drilling device according to an embodiment of the invention.
Figure 8:
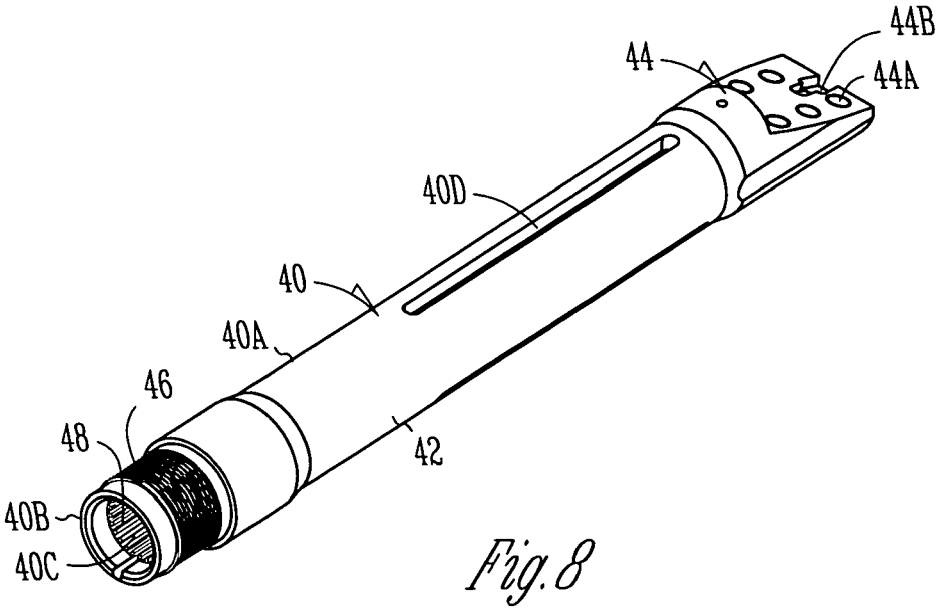
FIG. 8 shows a drill stem section of a drilling device according to an embodiment of the invention.
Figure 9A:
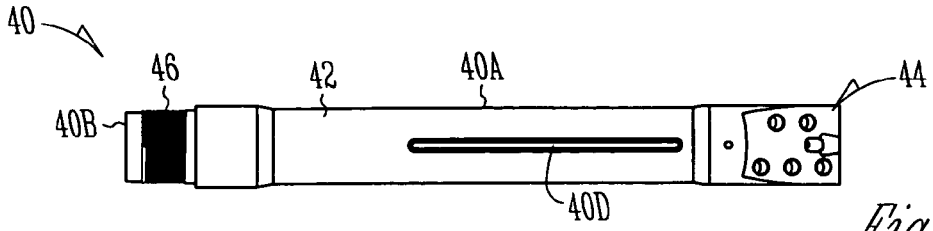
FIGS. 9A-9C show views of a drill stem section of a drilling device according to an embodiment of the invention.
Figure 9B:
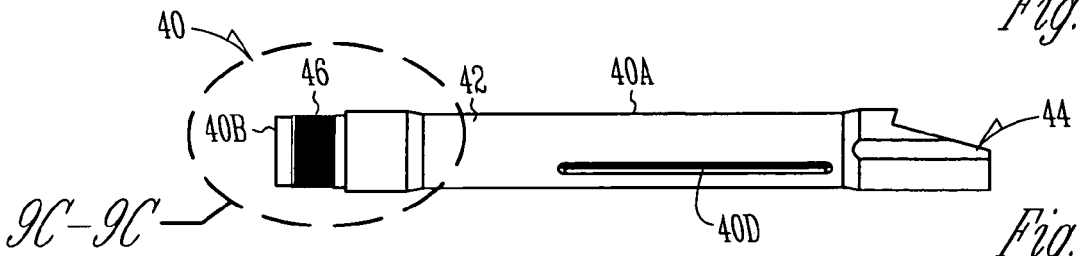
Figure 9C:
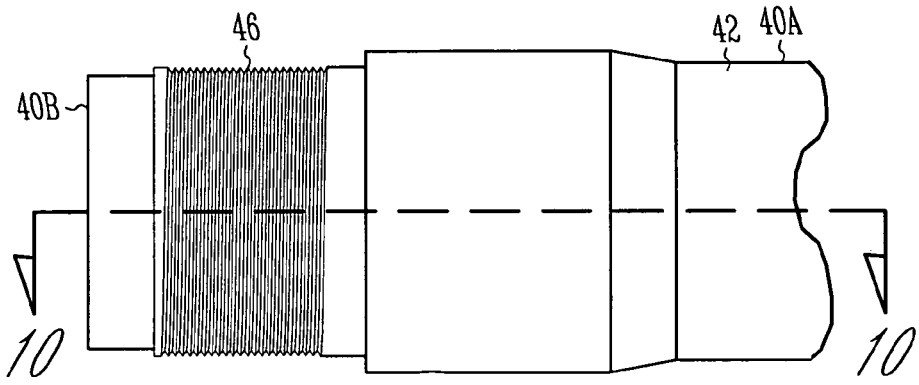
Figure 10:
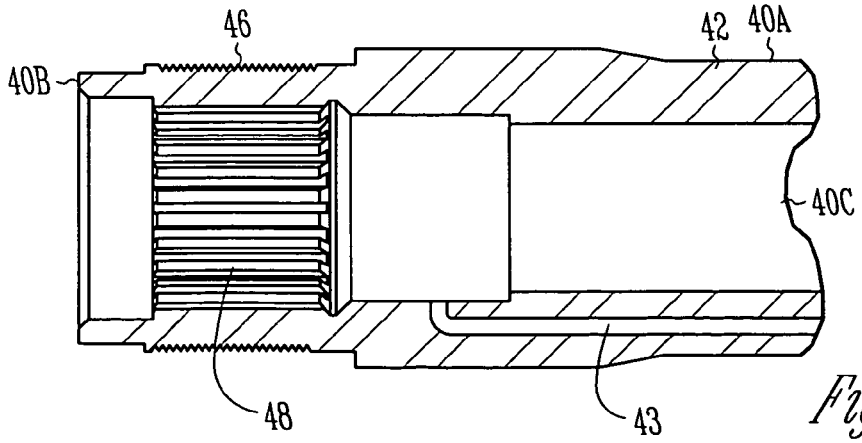
FIG. 10 is a cross-sectional view of the drill stem section of FIG. 9C taken along line 10-10.

Referring to FIGS. 1 and 2, there is shown a drilling device. Although an example of a directional drill stem portion 10 is used in the following descriptions, other drilling devices utilizing a number of sections of drill stem are also contemplated to be within the scope of the invention. It is noted that, while the drill stem portion 10 of FIGS. 1 and 2 is shown in isolation, it is intended that in use the drill stem portion 10 be attached to an end of a drill rod (not shown) at least during directional drilling. Additionally, typically, the drill stem portion 10 will be drivingly coupled to a drilling apparatus (not shown) during directional drilling. In this example, the drill stem portion 10 includes a threaded collar 20, an adapter 30, and an end portion 40. The end portion 40, in at least this example, includes a sonde housing 42 and a drill head 44.

Referring to FIGS. 5 and 6A-6C, the adapter 30 is generally cylindrical in shape, having a side wall 30*a* disposed between a first end 30*b* and a second end 30*c*. The first end 30*b* of this example includes interior adapter threads 36 configured to selectively engage conical threads (not shown) of an end of a drill rod (not shown). In other examples, it is contemplated that engagement structures other than conical adapter threads 36 are used at the first end 30*b*. The adapter 30 further includes a central passage 30*d* therethrough disposed between the first and second ends 30*b*, 30*c* through which fluid (not shown), such as bentonite fluid or other drilling fluid, optionally travels. Proximate the second end 30*c*, the central passage 30*d* includes a radial passage 38 that extends through the side wall 30*a* for fluid connection with a fluid passage within the end portion 40, which will be described in greater detail below. Although the end of the central passage 30*d* is shown as extending through the second end 30*c* of the adapter 30, in one example, it is intended that the end be closed off in a known way, such as by welding, inserting a stopper, etc., so that the fluid flows through the radial passage 38 and does not flow out of the second end 30*c* of the adapter 30. Although only one radial passage 38 is shown, it is within the spirit and scope of the present invention that there be more than one passage to facilitate the passage of fluid from the central passage 30*d* to the fluid passage of the end portion 40. An exterior of the side wall 30*a* of one example of the adapter 30 includes O-ring slots 35 on either longitudinal side from the radial passage 38 for accepting O-rings (not shown) for sealingly engaging the adapter 30 within the end portion 40 to inhibit fluid leakage into the interior of the end portion 40.

The adapter 30, in one example, further includes an engagement feature in the form of exterior adapter splines 32 disposed proximate the second end 30*c* of the adapter 30. In one embodiment, the adapter splines 32 are generally longitudinally oriented with respect to the adapter 30. The adapter 30, in one example, further includes a raised shoulder 34 optionally including a generally circumferential channel 34*a*, as shown in FIG. 5, for engagement with the threaded collar 20, as will be described below. In another example, the adapter 30 includes only a raised shoulder 34, as shown in FIGS. 6A and 6B, and does not include a circumferential channel. The shoulder 34 and optional circumferential channel 34*a* are configured for engagement with the threaded collar 20, as will be described in greater detail below.

Referring to FIGS. 7-10, the end portion 40 is generally cylindrical and includes a side wall 40*a* disposed between a first end 40*b* and the drill head 44. At least the sonde housing 42 of the end portion 40 includes a generally hollow interior 40*c* extending from the first end 40*b* to the drill head 44. In this example, the hollow interior 40*c* is configured to optionally accept a sonde (not shown) for sensing and sending drilling environment data to a user in a manner that is generally known to those skilled in the art. The side wall 40*a* in the area of the sonde housing 42 includes windows 40*d* therethrough to allow radio waves or other such sensing signals emitted from the sonde to exit the sonde housing 42. In one example, the end portion 40 includes three windows 40*d*, although it is within the spirit and scope of the present invention that there be more or less than three windows 40*d* through the side wall 40*a*, provided the sensing signals of the sonde are able to exit the sonde housing 42 in order to sense drilling environment characteristics. Additionally, although not shown in the figures, the windows 40*d* are intended to be covered or filled with epoxy or other such material that is permeable with respect to radio waves or other such signals emitted by the sonde. By filling or otherwise covering the windows 40*d*, fluid can be prevented or at least inhibited from entering the interior 40*c* of the end portion 40, thereby at least reducing the likelihood that the sonde inside the sonde housing 42 will become damaged by fluids, soil, mud, and other drilling-related contaminates encountered by the drill stem portion 10 during directional drilling.

In one example, the end portion 40 further includes end portion threads 46 on end exterior surface of the side wall 40*a*, disposed proximate the first end 40*b*. The end portion threads 46 are configured to engage the threaded collar 20, as described in more detail below. End portion splines 48 are disposed on an interior surface of the side wall 40*a* proximate the first end 40*b*. The end portion splines 48 are configured, in this example, to mate with and engage the adapter splines 32, such that, when engaged with the adapter splines 32, relative rotational motion of the adapter 30 with respect to the end portion 40 is inhibited thereby. Although a plurality of end portion splines 48 are shown disposed around the entire interior circumference of the end portion 40 and a plurality of adapter splines 32 are shown disposed around the entire exterior circumference of the adapter 30, it is within the spirit and scope of the present invention that the adapter and end portion splines 32, 48 be configured differently. For instance, the adapter splines 32 could be configured around an interior circumference of the adapter 30 and the end portion splines 48 could be configured around an exterior circumference of the end portion 40. Also, the adapter splines 32 could be disposed only around a portion of the circumference of the adapter 30 with the end portion splines 48 disposed around a corresponding portion of the circumference of the end portion 40. Additionally, one of the adapter 30 and the end portion 40 could have as few as one spline forming a projection and the other of the adapter 30 and the end portion 40 could have as few as two splines forming a slot for engagement of the projection therewith. Although not expressly shown or described herein, further engagement variations are contemplated in the present invention.

In one example, the drill head 44 of the end portion 40 includes a plurality of holes 44*a* for optional engagement of additional components such as steering blades (not shown), etc. with the drill head 44. In one example, the holes 44*a* are threaded for receiving fasteners (not shown). Additionally, the drill head 44 of this example includes a slot 44*b* for insertion and retention of a fluid port (not shown) or other tool and/or component suitable for use with a directional drill. The use of a steering blade is generally known in the art and, for this reason, will not be described in detail herein. The drill head 44 further includes a drill fluid outlet 44*c* (FIG. 7) for discharging drill fluid (not shown) into the fluid port within the slot 44*b* or otherwise discharging drill fluid within the drill hole during directional drilling. Fluid is often used to loosen the soil in the vicinity of the steering blade, thus making the drilling operation easier. In one example, the drilling fluid includes a bentonite lubricant. The drill fluid outlet 44*c* is fluidly coupled to the passage 38 of the adapter 30 with a drill fluid passageway 43 (see FIG. 10) in the side wall 40*a* of the end portion 40.

Referring now to FIGS. 3 and 4A-4C, the threaded collar 20 in one example includes a generally cylindrical side wall 20*a* disposed between first and second ends 20*b*, 20*c*. The threaded collar 20 is configured to fit over the adapter 30 and at least a portion of the end portion 40 to act to couple the adapter 30 to the end portion 40. In one example, the threaded collar 20 includes collar threads 26 on an interior surface of the side wall 20*a* configured to threadingly engage the end portion threads 46 described above. The collar threads 26 are configured to inhibit if not prevent loosening of the threaded collar 20 during rotation of the drill stem portion 10 during directional drilling. In one embodiment, the collar threads 26 are configured to be left-hand tightening threads so that rotation of the drill stem portion 10, which is intended to be rotated in a right-hand rotational direction, and, more specifically the frictional interaction of the drill stem portion 10 with respect to the material being drilled causes further tightening of the threaded collar 20.

Tightening of the collar threads 26 with the end portion threads 46 causes compression of a collar shoulder 20*d* of the threaded collar 20 against the shoulder 34 of adapter 30 to engage the adapter 30 with the end portion 40. In this way, tightening of the collar threads 26 with the end portion threads 46 inhibits axial movement of adapter 30 with respect to the end portion 40. Through holes 28 of the threaded collar 20 are configured to accept set screws (not shown) for optional engagement within channel 34*a* to further affix the threaded collar 20 to the adapter 30. Two holes 28 are shown in this example, although it is contemplated that there be more or less than two holes 28.

In one example, the collar threads 26 include one continuous thread with the end portion threads 46 including a corresponding thread. In another example, the collar threads 26 and the end portion threads 46 include more than one thread. In yet another example, the collar threads 26 and the end portion threads 46 include multiple, interlaced threads. For instance, the collar threads 26 could include two, three, or more interlaced threads with the end portion threads 46 including a corresponding number of threads. Multiple threads provide the same engagement surface area between the end portion threads 46 and the threaded collar threads 26 as a single thread. However, fewer rotations of the threaded collar 20 are required with multiple threads than are required for a single thread, leading to faster engagement/disengagement of the threaded collar 20 with the end portion 40.

The threaded collar 20 further includes end holes 24 disposed around the first end 20*b* configured to accept carbide blades to scrape away drill residue, i.e., caked on mud, rock, etc. during loosening of the collar 20. Although four end holes 24 are shown, it is contemplated that there be more or less than four end holes 24. Spanner features 22, such as holes, flats, etc., are located in an exterior of the side wall 20*a*. The spanner features 22 in this example only partially extend through the side wall 40*a* and are configured for engagement with a spanner (not shown) or other such tool configured to be used to tighten and/or loosen the threaded collar 20. In this example, there are two diametrically opposed spanner features 22, although it is within the spirit and scope of the present invention that there be more or less than two spanner features and/or that the spanner features not be diametrically opposed, provided a tool such as a spanner is still capable of being used to tighten and/or loosen the collar threads 26 of the threaded collar 20.

In this way, once engaged in a securing position (see FIGS. 1 and 2), the threaded engagement of the threaded collar 20 with the end portion 30 maintains the end portion 40 in engagement with the adapter 30 and, thereby, maintains mating engagement of the adapter splines 32 with the end portion splines 48 to transmit torque between the adapter 30 and the end portion 40. The engagement of the collar threads 26 with the end portion threads 46 transmits axial forces along the drill stem portion 10 but does not transmit torque forces due to the above-described interaction of the end portion splines 48 and the adapter splines 32. By isolating the torque forces and the axial forces in this way, the threaded collar 20 does not become over-tightened by rotation of the drill stem portion 10 during a drilling operation and, therefore, requires relatively little force by a user to remove the threaded collar 20 from the end portion threads 46, when it is desired to disassemble the drill stem portion 10 after a drilling operation.

The threaded collar 20, when engaged with the adapter 30 and the end portion 40, not only acts to maintain connection of the adapter 30 and the end portion 40, but also protects a joint between the adapter 30 and the end portion 40 by at least partially covering the joint. In one example, the threaded collar 20 completely covers the joint to inhibit encroachment of drilling byproducts, such as fluid, soil, rocks, etc., within the joint.

In operation, the threaded collar 20 is slidably disposed between the first end 30*b* and the shoulder 34 of the adapter with the second end 20*c* of the threaded collar 20 facing in the direction of the second end 30*c* of the adapter 30. The adapter threads 36 of the adapter 30 are then threadably engaged with an end (not shown) of a generally known drill rod (not shown). The first end 40*b* of the end portion 40 is then slipped over the second end 30*c* of the adapter 30 so that the adapter splines 32 engage with the mating end portion splines 48, with the first end 40*b* of the end portion 40 abutting the shoulder 34 of the adapter 30 in one example. The treaded collar 20 is passed along the adapter 30 toward the end portion 40 and into engagement with the end portion threads 46, at which point the collar threads 26 are engaged therewith. Optionally, a spanner (not shown) can be engaged with the spanner features 22 of the threaded collar 20 to gain a mechanical advantage in order to further tighten the threaded collar 20 onto the end portion threads 46, thereby compressing the joint between the end portion 40 and the adapter 30. Optionally, set screws (not shown), such as allen bolts, hex bolts, screws, and the like, can be threaded into the through holes 28 in the threaded collar 20, such that ends of the set screws become disposed within the channel 34*a*, further optionally biting into an exterior of the adapter 30 within the channel 34*a*. In this way, the threaded collar can be optionally further engaged with the drill stem portion 10 to lessen the likelihood that the threaded collar 20 becomes dislodged from its engagement with the end portion 40. The drill stem portion 10 can then be used in a directional drilling operation to bore through soil, rock, clay, etc. in order to create a directional drilling hole in a manner generally known to those skilled in the art. It is further contemplated that the collar threads 26 be left-handed, such that frictional interaction of the threaded collar 20 with the drill bore causes further tightening of the threaded collar 20 onto the end portion threads 46 to further lessen the likelihood of disengagement of the end portion 40. This promotes a secure attachment of the end portion 40 and the adapter 30 during a drilling operation. Because the threaded collar 20 at least partially covers the joint between the end portion 40 and the adapter 30, the joint is protected from the incursion of drilling byproducts, such as soil, rocks, fluid, etc.

After performing a desired drilling operation, the drill stem portion 10 can be removed from within the drill bore, either by backing the drill stem portion 10 out or by passing the drill stem portion 10 completely through the drill bore. At this point, if desired, the end portion 40 can be removed from the adapter 30 by loosening the threaded collar 20. If used, the set screws of the threaded collar 20 are loosened to disengage the set screws from within the channel 34*a* of the adapter 30. The threaded collar 20 is then loosened and removed from engagement with the end portion threads 46. As discussed above, because the collar threads 26 are only tightened due to friction, are not tightened due to drill stem rotation, a lower amount of force is required to loosen the threaded collar 20. Optionally, the spanner is engaged within the spanner features 22 and is used to gain a mechanical advantage in loosening the thread collar 20 from engagement with the end portion 40. Use of the spanner in this way eliminates the unsafe and relatively common practice of using pipe wrenches (not shown) or other such devices to loosen the sections of the drill stem.

Although the above description relates to the use of the threaded collar 20 with the end portion 40 and adapter 30, it is within the spirit and scope of the present invention that the threaded collar 20 be used with other joints between other sections of the drill stem, including, but not limited to, between drill rods, between a drill rod and the sonde housing, between the sonde housing and the drill head, etc. Additionally, although the above description primarily relates to the adapter splines 32 and the end portion splines 48 as the engagement/mating features of the end portion 40 and the adapter 30, it is within the spirit and scope of the present invention that other engagement/mating features be used in conjunction with the threaded collar 20.

Figure 11:
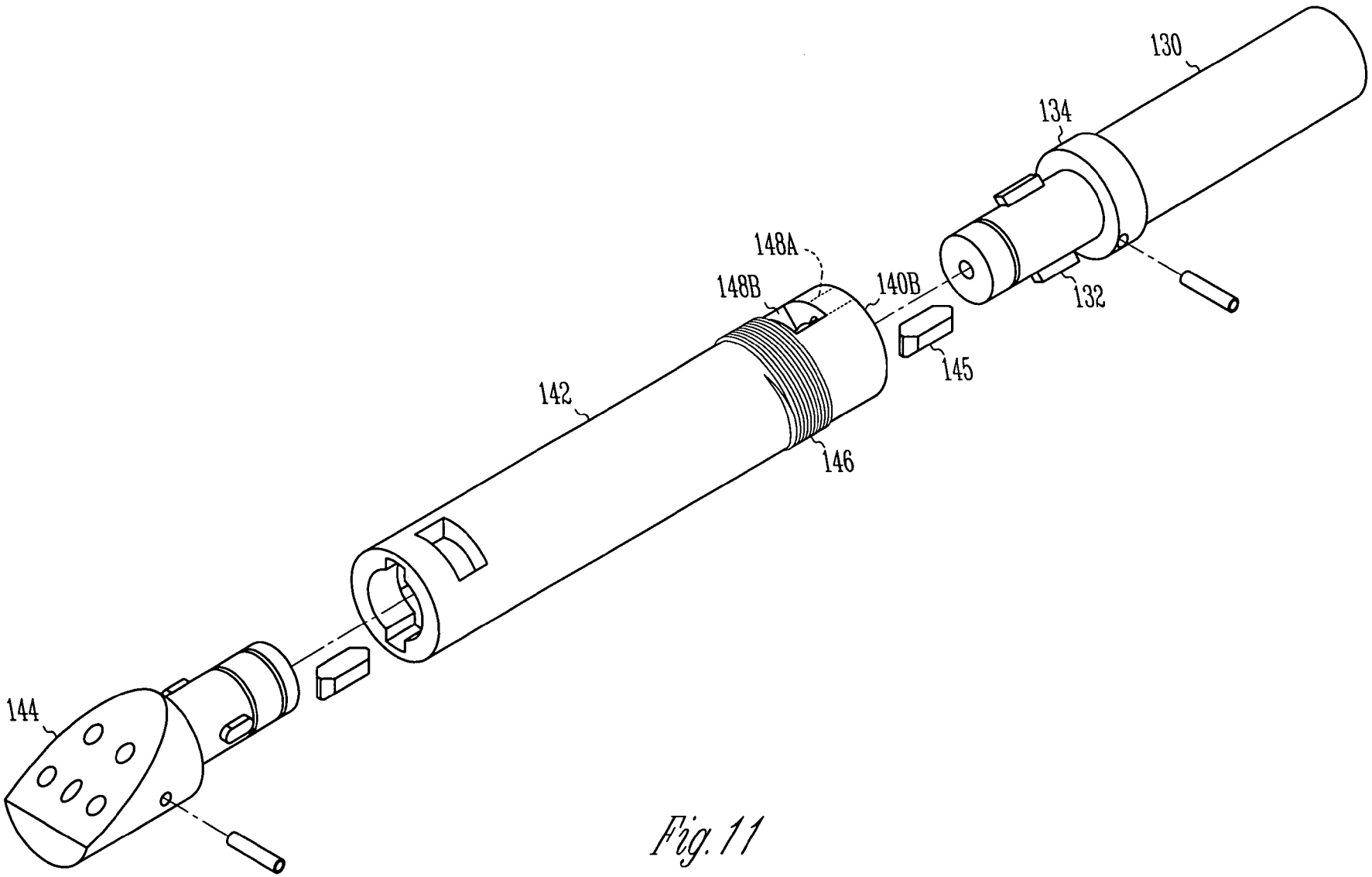
FIG. 11 is an exploded view of a drilling device according to an embodiment of the invention.
Figure 12:
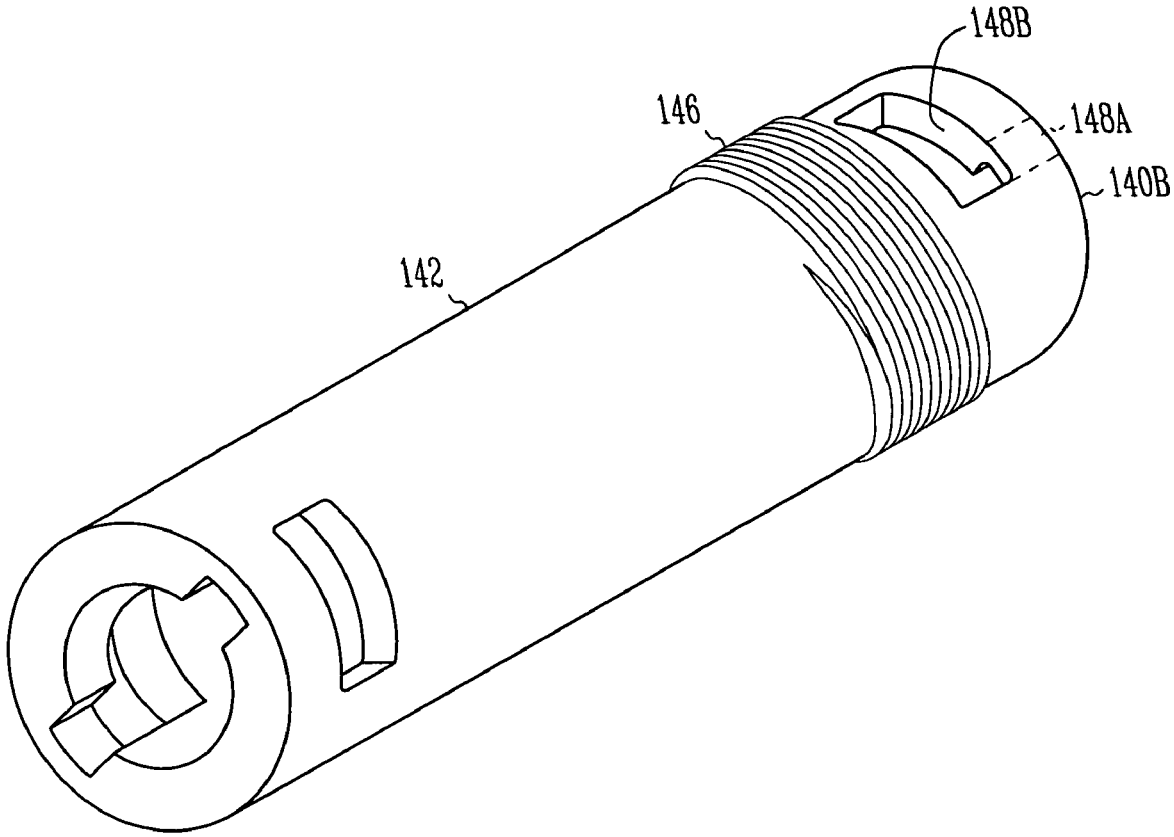
FIG. 12 shows a drill stem component of the drilling device of FIG. 11.

For instance, in another example, referring to FIGS. 11 and 12, a sonde housing 142 includes at least one twist-and-lock slot 148, and an adapter 130 includes at least one corresponding protruding lobe 132 for selective engagement within the twist-and-lock slot 148. More information regarding this twist-and-lock configuration can be found in U.S. patent application Ser. No. 10/757,378 entitled Connection Design and Sonde Housing Assembly for a Directional Drill, which is incorporated by reference herein in its entirety. In one example, the twist-and-lock slot 148 is proximate a first end 140*b* of the sonde housing 148 and includes a first portion 148*a* generally longitudinally oriented with respect to the sonde housing 142 and a second portion 148*b* generally radially oriented with respect to the sonde housing 142. In this way, the protruding lobe 132 is inserted within the first portion 148*a*, and the adapter 130 is twisted with respect to the sonde housing 142 to slide the protruding lobe 132 into the second portion 148*b* and locked into place using, for instance, an insert 145. Once the protruding lobe 132 is engaged within the second portion 148*b* of the twist-and-lock slot 148, a threaded collar (not shown, but substantially similar to the thread collar 20 discussed above) is threadably engaged with sonde threads 146 proximate the first end 140*b* of the sonde housing 142. In a manner similar to that described above, the threaded collar, as it is tightened, abuts a shoulder 134 of the adapter 130 and compresses a joint between the adapter 130 and the sonde housing 142. In this way, the threaded collar acts to couple the sonde housing 142 and the adapter 130 and provides at least some protection from drilling byproducts of the joint to facilitate disassembly after use.

It is noted that the above-discussed examples of drill stem couplings including the threaded collar are merely exemplary and that other configurations not specifically discussed herein are considered to be within the spirit and scope of the present invention. For instance, the thread collar discussed herein could be used with other engagement/mating features of drill stem components, whether initially designed to be used with the threaded collar or whether existing drill stem components having engagement/mating features are retrofitted for use with the threaded collar.

The above-described drill stem coupling of the drill stem portion 10, namely, the threaded collar 20 used in conjunction with the adapter 30, 130 and the end portion 40 or sonde housing 142, is intended to provide a robust coupling for use during drilling operations in which torque forces are isolated to lessen the likelihood of the drill stem components becoming overly tightened and, as a result, difficult to separate. Because torque forces do not act to further tighten the threaded collar 20 of the present invention, the threaded collar 20 is relatively easier to remove than previously known drill stem couplings. As such, the present invention decreases the need to use large pipe wrenches or other such tools, which can be dangerous for a user to try to use and/or restrain, especially when the user is within a confined area such as a drill pit.

Additionally, as stated above, the threaded collar 20 in the secured position acts to at least partially cover the joint between the adapter 30, 130 and the end portion 40 or sonde housing 142, which serves to protect the joint from incursion of dirt, fluid, and other drilling debris into and around the joint. In this way, the threaded collar 20 acts to inhibit such debris from becoming lodged in and around the joint, thereby facilitating disassembly of the adapter 30, 130 and the end portion 40 or sonde housing 142.

While a number of advantages of embodiments described herein are listed above, the list is not exhaustive. Other advantages of embodiments described above will be apparent to one of ordinary skill in the art, having read the present disclosure. Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. It is to be understood that the above description is intended to be illustrative, and not restrictive. Combinations of the above embodiments, and other embodiments will be apparent to those of skill in the art upon reviewing the above description. The scope of the invention includes any other applications in which the above structures and fabrication methods are used. The scope of the invention should be determined with reference to the appended claims, along with the full scope of equivalents to which such claims are entitled.

What is claimed is:

1. A drill stem connection assembly, comprising:

a first drill stem section;

a second drill stem section;

at least one engaging feature located at an end of the first drill stem section;

at least one mating feature for accepting the at least one engaging feature, the at least one mating feature located at an end of the second drill stem section, wherein coupling of the respective ends of the first and second drill stem sections forms a drill stem joint; and a threaded collar for engagement with at least one of the coupled first and second drill stem sections, wherein, when placed in a securing position, the threaded collar holds the engaging feature securely mated with the mating feature and at least partially covers the drill stem joint, the threaded collar including a carbide insert axially extending from an end of the threaded collar.

2. The drill stem connection assembly of claim 1, wherein the at least one engaging feature includes at least one spline, and the at least one mating feature includes at least one corresponding spline.

3. The drill stem connection assembly of claim 2, wherein the at least one engaging feature further includes at least one projection, and the at least one mating feature further includes at least one slot.

4. The drill stem connection assembly of claim 1, wherein the at least one engaging feature includes at least one projection, and the at least one mating feature includes at least one slot.

5. The drill stem connection assembly of claim 1, wherein the at least one engaging feature includes a plurality of splines, and the at least one mating feature includes a plurality of corresponding splines.

6. The drill stem connection assembly of claim 1, wherein the threaded collar is slideably disposed along one of the first and second drill stem sections and is selectively securable to the other of the first and second drill stem sections.

7. The drill stem connection assembly of claim 6, wherein the threaded collar is slideably disposed along the first drill stem section and selectively threadably engaged with the second drill stem section.

8. The drill stem connection assembly of claim 7, wherein the threaded collar includes a set screw to selectively engage the threaded collar with the first drill stem section.

9. The drill stem connection assembly of claim 1, wherein the first drill stem section includes a length of drill rod.

10. The drill stem connection assembly of claim 9, wherein the second drill stem section includes a sonde housing.

11. The drill stem connection assembly of claim 1, wherein the first drill stem section includes a sonde housing and the second drill stem section includes a drill head.

12. The drill stem connection assembly of claim 1, wherein the threaded collar in the securing position inhibits the first and second drill stem sections from relative axial movement, and the at least one engaging feature and the at least one mating feature inhibit the first and second drill stem sections from relative rotational movement.

13. The drill stem connection assembly of claim 1, wherein the threaded collar completely covers the drill stem joint to inhibit encroachment of drilling byproducts within the drill stem joint.

14. The drill stem connection assembly of claim 1, wherein the threaded collar includes a left hand thread to frictionally tighten the threaded collar as the drill stem connection assembly rotates in a drilling medium.

15. The drill stem connection assembly of claim 14, wherein the threaded collar further includes a set screw to selectively engage the threaded collar with one of the first and second drill stem sections.

16. The drill stem connection assembly of claim 1, wherein the threaded collar further includes more than one thread.

17. A drill stem connection assembly, comprising:

a first drill stem section;

a second drill stem section;

a plurality of first splines located at an end of the first drill stem section;

a plurality of second splines complementarily shaped with the plurality of first splines to accept the plurality of first splines, the plurality of second splines located at an end of the second drill stem section, wherein coupling of the respective ends of the first and second drill stem sections forms a drill stem joint; and a threaded collar for engagement with at least one of the coupled first and second drill stem sections, wherein, when placed in a securing position, the threaded collar holds the plurality of first splines engaged with the plurality of second splines and covers the drill stem joint, the threaded collar including two or more interlaced threads configured to threadably engage mating threads of at least one of the first drill stem section or the second drill stem section.

18. The drill stem connection assembly of claim 17, wherein the threaded collar includes a set screw to selectively engage the threaded collar with the first drill stem section.

19. The drill stem connection assembly of claim 17, wherein the first drill stem section includes a length of drill rod, and the second drill stem section includes a sonde housing.

20. The drill stem connection assembly of claim 17, wherein the first drill stem section includes a sonde housing and the second drill stem section includes a drill head.

21. The drill stem connection assembly of claim 17, wherein the threaded collar includes a left hand thread to frictionally tighten the threaded collar as the drill stem connection assembly rotates in a drilling medium.

22. A sonde housing for use with a drill stem, comprising:

an elongate member having first and second oppositely disposed ends, the elongate member having a chamber for holding a sonde;

a sonde engagement feature disposed on at least one of the first and second ends of the elongate member, the sonde engagement feature sized and shaped to correspond with a component engagement feature of a drill stem section at a drill stem joint; and a threaded collar configured to slide over and cover the drill stem joint, the threaded collar including a carbide insert axially extending from an end of the threaded collar, wherein, when threaded, the collar transmits axial force at the drill stem joint, and holds the sonde engagement feature in connection with the component engagement feature.

23. The sonde housing of claim 22, wherein the sonde engagement feature is a plurality of male splines substantially aligned with a drill stem axis.

24. The sonde housing of claim 22, wherein the sonde engagement feature is a plurality of female splines substantially aligned with a drill stem axis.

25. The sonde housing of claim 22, wherein the sonde engagement feature is at least one protruding lobe and the component engagement feature is a twist and lock slot.

26. The sonde housing of claim 22, wherein the sonde engagement feature is a twist and lock slot and the component engagement feature is at least one protruding lobe.

27. The sonde housing of claim 22, further comprising a fluid passage through a portion of the elongate member.

28. The sonde housing of claim 22, wherein the threaded collar includes a set screw to selectively engage the threaded collar with the elongate member.

29. The sonde housing of claim 22, wherein the threaded collar includes a left hand thread to frictionally tighten the threaded collar as the drill stem rotates in a drilling medium.

30. The sonde housing of claim 29, wherein the threaded collar further includes a set screw to selectively engage the threaded collar with the elongate member.

31. A method of drill stem assembly, comprising:

engaging at least one radial feature between two drill stem sections to transmit torque; and threading a collar over the interface between the drill stem sections to hold the radial feature in engagement, the collar including two or more interlaced threads configured to threadably engage mating threads of at least one of the two drill stem sections, wherein the threads transmit axial forces, but not torque forces, the collar including a carbide insert axially extending from an end of the collar to remove debris from at least one of the two drill stem sections.

32. The method of claim 31, further comprising engaging a set screw of the collar with one of the drill stem sections to inhibit motion of the collar relative the drill stem sections.

* * * * *

UNITED STATES PATENT AND TRADEMARK OFFICE

CERTIFICATE OF CORRECTION

PATENT NO. : 7,654,341 B2
APPLICATION NO. : 11/553337
DATED : February 2, 2010
INVENTOR(S) : Michael Tjader It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 548 days.

Signed and Sealed this

Twenty-eighth Day of December, 2010

David J. Kappos

David J. Kappos
*Director of the United States Patent and Trademark Office*